US006817041B1

(12) United States Patent
Evans et al.

(10) Patent No.: US 6,817,041 B1
(45) Date of Patent: Nov. 16, 2004

(54) SKIMMER GUARD

(75) Inventors: Cliff Evans, Newton, CT (US); Mark W. Dalton, Danbury, CT (US)

(73) Assignee: North American Marketing Corporation, Manchester, CT (US)

( * ) Notice: Subject to any disclaimer, the term of this patent is extended or adjusted under 35 U.S.C. 154(b) by 0 days.

(21) Appl. No.: 10/639,034

(22) Filed: Aug. 12, 2003

(51) Int. Cl.[7] ..... E04H 4/12
(52) U.S. Cl. ..... 4/496; 4/507; 210/463
(58) Field of Search ..... 4/496, 507; 210/163, 210/416.2, 459, 460, 462, 463

(56) References Cited

U.S. PATENT DOCUMENTS

| | | | | |
|---|---|---|---|---|
| 1,811,728 A | * | 6/1931 | McKee | 210/463 |
| 3,086,655 A | * | 4/1963 | Compton | 210/463 X |
| 3,186,550 A | | 6/1965 | Beduhn | |
| 3,268,079 A | | 8/1966 | Sharrow, Jr. | |
| 3,314,543 A | | 4/1967 | Nash | |
| 3,372,809 A | | 3/1968 | Spitzer | |
| 3,668,712 A | | 6/1972 | Baker | |
| 3,767,055 A | | 10/1973 | Flatland | |
| 3,918,107 A | | 11/1975 | Whitten, Jr. et al. | |
| 4,140,634 A | | 2/1979 | Harry | |
| 4,332,683 A | | 6/1982 | Alt | |
| 4,421,644 A | | 12/1983 | Gedye | |
| 4,426,286 A | | 1/1984 | Puckett et al. | |
| 4,594,024 A | | 6/1986 | Jenkner et al. | |
| 5,536,406 A | | 7/1996 | Silva | |
| 5,672,271 A | | 9/1997 | Dye | |
| 5,759,388 A | | 6/1998 | Cote | |
| 5,935,450 A | | 8/1999 | Benedict | |
| 6,214,217 B1 | | 4/2001 | Sliger, Jr. | |

* cited by examiner

*Primary Examiner*—Robert M. Fetsuga
(74) *Attorney, Agent, or Firm*—Pepe & Hazard LLP

(57) ABSTRACT

A skimmer guard has first and second brackets configured to bear against opposite walls of a skimmer passageway, and a plurality of resiliently deflectable ribs extending between the first and second brackets for blocking objects from passing into the skimmer. The ribs are configured and dimensioned to bias the first and second brackets against the second wall of the skimmer passageway to hold guard in a fixed position.

20 Claims, 3 Drawing Sheets

SKIMMER GUARD

BACKGROUND OF THE INVENTION

The present invention generally relates to swimming pools and spas, and, more particularly to skimmers used in pools and spas.

Conventional pool filtration systems include a skimmer for circulating water through the filtration system and removing larger floating debris from the surface of the water. The skimmer typically includes a skimmer mouth or opening in the pool wall adjacent the surface of the water. The opening is connected to a passageway which extends from the pool wall to a filtration basket which catches large particles such as leaves, thereby removing them from the pool and keeping them out of the water recirculation lines and fine filter media. Water which exits the pool through the basket in the skimmer passageway is drawn into the main filter in order to remove the small particles. The filtered water is then recirculated to the pool through return lines.

Due to suction in the skimmer line, large floating objects, such as toys and floating chlorinators, can block the mouth and passageway of the skimmer, thereby decreasing the water flow to the filter. As a result, the pump will be required to work harder to maintain a proper flow of water through the skimmer line, reducing pump life and filtration efficiency.

It is an object of the present invention is to provide a novel skimmer guard that will prevent large objects from entering the skimmer passageway.

Another object is to provide such a skimmer guard that can be quickly installed and removed without the use of tools.

Yet another object of the invention is to provide such a skimmer guard that can be installed easily without ancillary hooks or fasteners.

A further object is to provide such a skimmer guard that is economical to manufacture.

SUMMARY OF THE INVENTION

It has now been found that the foregoing and related objects may be readily attained in a skimmer guard which has first and second brackets configured to bear against opposite opposed walls of a skimmer passageway, and a plurality of resiliently deflectable ribs extending between the first and second brackets for blocking objects from entering the skimmer. The ribs are dimensioned and configured to bias the first and second brackets against the opposed walls of the skimmer passageway to seat the skimmer guard in a fixed position.

Each of the first and second brackets usually includes a support leg having an inner surface which supports the ribs and an outer surface configured to bear against the opposite walls of the skimmer passageway. The outer surface of each of the support legs preferably has a plurality of ridges formed thereon that are configured for frictional engagement with the opposite walls of the skimmer opening. Desirably, the first and second brackets each include a positioning leg extending perpendicularly outwardly from the support leg to bear against the face plate or outer surface of the skimmer or the pool sidewall to position the bracket at the inlet end of the skimmer passageway. Thus, the brackets typically have an inverted L-shaped cross section.

Usually, the ribs are generally parallel to one another, and have a portion which is curved in the direction opposite to the direction of water flow through the skimmer passageway in order to deflect objects away from the skimmer passageway.

The brackets may also have a spacer removably seated on the outer surface of the support legs.

DETAILED DESCRIPTION OF THE PREFERRED EMBODIMENT

Figure 1:
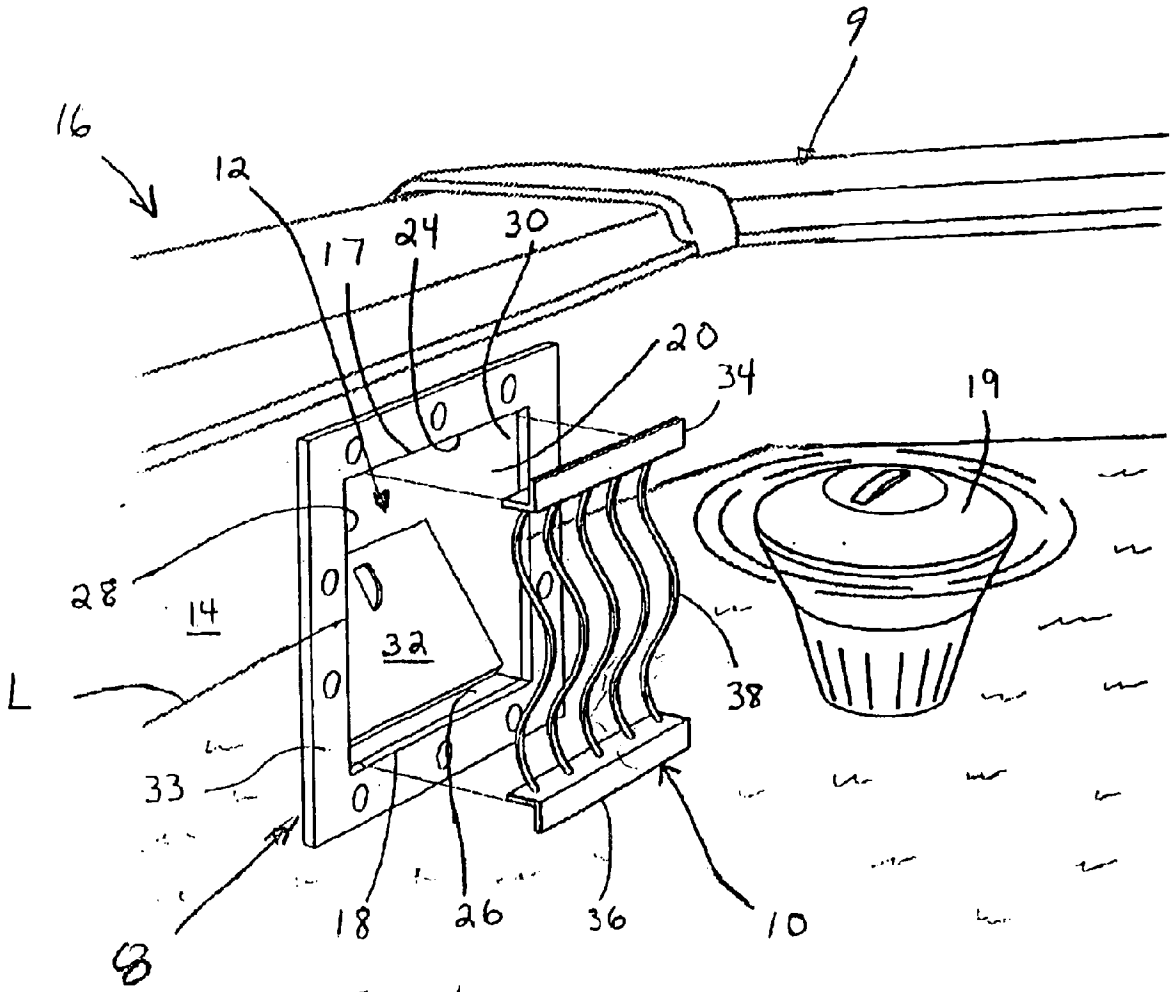
FIG. 1 is a fragmentary perspective view of a pool wall with a skimmer mounted therein, and a skimmer guard embodying the present invention positioned for mounting in the skimmer opening, and a floating object.

Turning first to FIG. 1 of the attached drawings, therein illustrated is a skimmer guard embodying the present invention and generally designated by the numeral 10. The skimmer guard 10 is snapped into place in the rectangular mouth or opening 12 of the skimmer generally designated by the numeral 8. The skimmer 8 is mounted in an opening formed in the sidewall 14 of a pool 16 with the water level "L" being maintained between the upper edge 17 and lower edge 18 of the skimmer mouth 12. The skimmer guard 10 prevents large objects such as a chlorinator 19 from blocking the entry of water into the skimmer mouth 12.

The skimmer mouth 12 is the entryway into a skimmer passageway 20 which extends generally horizontally outwardly from the pool 16 under the pool deck 9. At the end of the skimmer passageway 20 is a filtration basket (not shown) which collects debris. Beneath the basket, a skimmer suction line (not shown) draws water from the skimmer passageway 20 through the main filtration system (not shown) of the pool and recirculates the filtered water back to the pool through the return lines. The skimmer passageway 20 typically is rectangular in cross section and includes a top wall 24, a bottom wall 26, and sidewalls 28, 30. A pivoting weir 32 is mounted at its entrance to provide for a flow of water therethrough when the level of water is above the bottom of the skimmer mouth 12. A rectangular face plate 33 typically surrounds the skimmer mouth 12 and is secured to the sidewall 14 of the pool 16.

The skimmer guard 10 has upper and lower brackets 34, 36 of inverted L-shaped cross section to provide secure seating in the skimmer mouth 12. The length of the brackets 34, 36 preferably corresponds to the length of the upper and lower edges 17, 18 of the skimmer mouth 12. A plurality of parallel, serpentine and resiliently deflectable ribs 38 extends between the upper and lower brackets 34, 36. The ribs 38 are contoured in the direction parallel to the direction of water flow through the passageway 20. Preferably, the ribs are equally spaced from one another and are about 1" apart forming a grating which, as mentioned above, prevents large floating objects from blocking the skimmer mouth 12.

As shown in FIGS. 2–5, the upper bracket 34 includes a flat, bar-shaped support leg 46 which supports the upper end of the ribs 38 and it bears against the upper edge 17 of the skimmer passageway 20. A perpendicular, outwardly disposed positioning member 48 positions the skimmer guard 10 in the skimmer passageway at the skimmer mouth 12. Similarly, the lower bracket 36 has a support leg 47 and positioning leg 49. The outer faces of the support legs 46, 47 have a plurality of narrow ridges 52, 53 extending along their length in order to promote good frictional engagement of the support members 46, 47 with the top and bottom walls 24, 26 of the skimmer passageway 20.

In the embodiment shown in FIGS. 1–7, each rib 38 has a central, outwardly curving section 60 when viewed from inside the pool, and upper and lower inwardly curved sections 62,64. This particular configuration has been found optimal for deflecting floating objects away from the skimmer mouth. Ribs having other types of contours could be used provided that they readily deflect.

Figure 4:
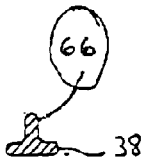
FIG. 4 is a cross sectional view of a rib taken along the line 4—4 of FIG. 3.

Each individual rib 38 has a T-shaped cross section as shown in FIG. 4 to provide a combination of strength and flexibility which enables the skimmer guard 10 to be mounted and removed by snap fitting, thereby rendering unnecessary the use of tools or fasteners for mounting or removal.

Figure 5:
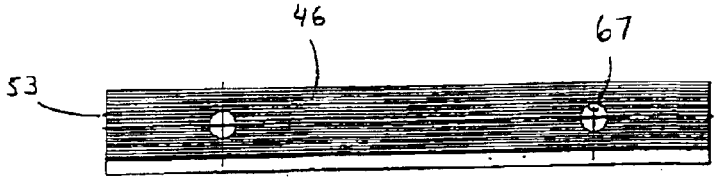
FIG. 5 is a bottom view of the skimmer guard.
Figure 2:
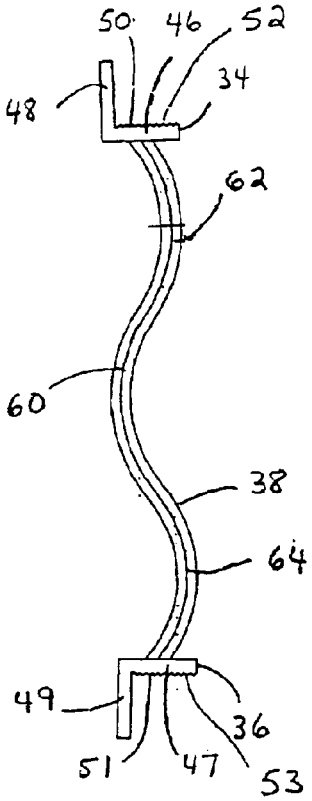
FIG. 2 is a side elevational view of the skimmer guard shown in FIG. 1 drawn to an enlarged scale.
Figure 3:
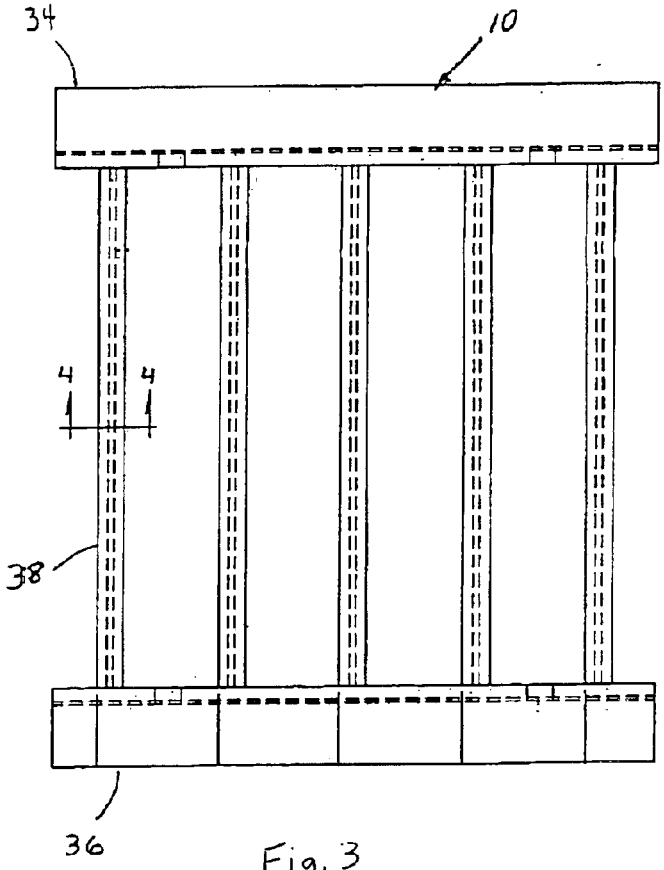
FIG. 3 is a front elevational view of the skimmer guard.
Figure 7:
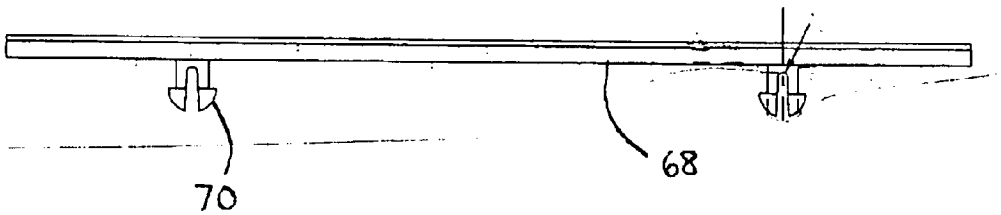
FIG. 7 is a front view of a spacer.
Figure 6:
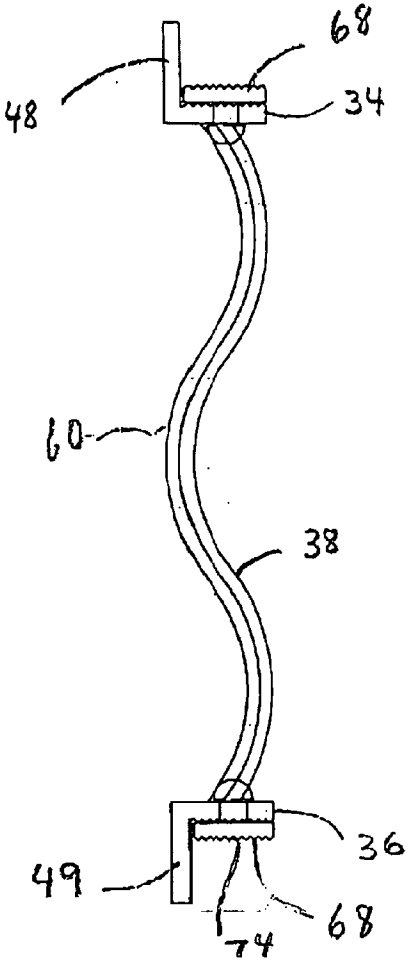
FIG. 6 is a side elevational view of the skimmer guard with a pair of spacers mounted thereon.

As is shown in FIGS. 5–7, the upper and lower support legs 46, 48 have a pair of apertures 67 formed therein for receiving the lugs 70 of spacers 68, which are mounted thereon by a snap fit. One or two spacers 68 can be used to increase the effective distance between the upper and lower surfaces of the guard 10 in order to seat snugly within a larger skimmer mouth 12. Spacers 68 of varying thicknesses can be used. This feature of the invention enables a single skimmer guard to be effectively used in skimmer mouths having openings of various sizes. The lugs 70 are configured to snap in and out of apertures 67 formed in the support legs 46, 48, thereby enabling quick and easy mounting and removal without the use of tools. The outer face 72 of each spacer 68 preferably has a plurality of longitudinal ridges 74 that extend along the length of the spacer 68 in order to promote good frictional engagement of the spacer 68 with the adjacent surface of the skimmer passageway.

The skimmer guard 10 preferably is injection or compression molded in one piece from a resiliently deflectable thermoplastic or thermoset material and the serpentine configuration enhances the ability of the ribs 38 to deflect, thus enabling the skimmer guard 10 to be snapped in and out of position in the skimmer passageway 20. Suitable resins include ABS and polypropylene.

To install the skimmer guard 10, the lower bracket 36 (with a spacer 68 mounted thereon if desired), is engaged in the lower end 18 of the skimmer mouth 12 and the upper bracket 34 (with a spacer 68 mounted thereon if needed), is pushed downwardly and inwardly until it snaps into place against the upper edge 17 of the skimmer mouth 12.

Thus, it can be seen from the foregoing detailed description and attached drawings that the skimmer guard of the present invention provides an effective solution to the problem of skimmer blockage by employing a device which is quickly and easily installed at the inlet to a skimmer passageway. The guard can be readily and economically fabricated and easily mounted in skimmer mouths of a variety of sizes.

Having thus described the claims, what is claimed is:

1. A skimmer guard comprising:

(a) first and second brackets configured to bear against opposite walls of a skimmer passageway; and (b) a plurality of resiliently deflectable ribs extending between said first and second brackets for blocking objects from entering the skimmer passageway, said ribs being dimensioned and configured to bias said first and second brackets against the opposite walls of the skimmer passageway to seat said skimmer guard in a fixed position.

2. The skimmer guard in accordance with claim 1 wherein each of said first and second brackets includes a support leg having an inner surface which supports said ribs and an outer surface configured to bear against one the opposite walls of the skimmer passageway.

3. The skimmer guard in accordance with claim 2 wherein said outer surface of each of said support legs has a plurality of ridges formed thereon configured for frictional engagement with one of the opposite walls of the skimmer passageway.

4. The skimmer guard in accordance with claim 2 wherein said brackets include a positioning leg extending perpendicularly from said support leg to bear against the surface of the skimmer or pool wall to position said bracket at the inlet end of the skimmer passageway.

5. The skimmer guard in accordance with claim 4 wherein each of said brackets has an inverted L-shaped cross section.

6. The skimmer guard in accordance with claim 1 wherein said ribs are generally parallel.

7. The skimmer guard in accordance with claim 1 wherein said ribs have a portion curved in the direction opposite to the direction of water flow through the skimmer passageway to deflect objects away from the skimmer passageway.

8. The skimmer guard in accordance with claim 1 wherein said ribs have a serpentine configuration.

9. The skimmer guard in accordance with claim 1 wherein there is included at least one spacer seated on the outer surface of one of the support legs.

10. The skimmer guard in accordance with claim 9 wherein said spacer is removably mounted on said support member.

11. The skimmer guard in accordance with claim 9 wherein said spacer has a plurality of lugs seated in apertures in said support leg.

12. A pool installation including:

(a) a water-retaining enclosure including a pool sidewall having an opening therein;

(b) a skimmer seated in said opening of said pool sidewall and providing a skimmer mouth at the entrance to a skimmer passageway having opposite sidewalls;

(c) a skimmer guard removably mounted in said skimmer passageway, said skimmer guard including first and second brackets resiliently bearing against said opposite sidewalls of said skimmer passageway, and a plurality of resiliently deflectable ribs extending between said first and second brackets for preventing the entry of objects into said skimmer passageway, said ribs being dimensioned and configured to bias said first and second brackets against said opposite walls of said skimmer passageway to seat said skimmer guard in a fixed position.

13. The pool installation in accordance with claim 12 wherein each of said first and second brackets includes a support leg having an inner surface which supports said ribs and an outer surface configured to bear against said opposite walls of said skimmer passageway.

14. The pool installation in accordance with claim 13 wherein said outer surface of each of said support legs has a plurality of ridges formed thereon configured for frictional engagement with one of said opposite walls of said skimmer passageway.

15. The pool installation in accordance with claim 14 wherein said first and second brackets include a positioning leg extending perpendicularly outwardly from said support leg to bear against the surface of the skimmer or pool wall to position said bracket at an inlet end of said skimmer passageway.

16. The pool installation in accordance with claim 12 wherein said ribs have a portion curved in a direction opposite to the direction of water flow through said skimmer passageway in order to deflect objects away from said skimmer passageway.

17. The pool installation in accordance with claim 12 wherein said ribs are of serpentine configuration.

18. The pool installation in accordance with claim 12 wherein one of said brackets has a spacer on the outer surface of said support leg.

19. The poll installation in accordance with claim 12 is included at least one spacer seated on the outer surface of one of the support legs.

20. The pool installation in accordance with claim 12 wherein each of said brackets has an inverted L-shaped cross section.

* * * * *